US005906455A

United States Patent [19]

McLaughlin

[11] Patent Number: 5,906,455

[45] Date of Patent: May 25, 1999

[54] CONCRETE FINISHING DEVICE FOR STEPS

[76] Inventor: Frederick Arthur McLaughlin, 8747 Schoolhouse La., Coopersburg, Pa. 18036

[21] Appl. No.: 08/871,697

[22] Filed: Jun. 9, 1997

[51] Int. Cl.[6] ..... E04G 21/10; E01C 19/22; E05C 17/10

[52] U.S. Cl. ..... 404/97; 404/96; 15/235.4

[58] Field of Search ..... 404/97, 96; 15/235.8, 15/235.3, 235.4; 425/458

[56] References Cited

U.S. PATENT DOCUMENTS

| | | | |
|---|---|---|---|
| 980,177 | 12/1910 | Koschke | 15/235.8 |
| 1,068,683 | 7/1913 | Malek | 15/235.8 |
| 1,091,370 | 3/1914 | Menke | 15/235.8 |
| 1,726,119 | 8/1929 | Paquette | 15/235.8 |
| 2,526,401 | 10/1950 | Oscar | 15/235.8 |
| 3,947,916 | 4/1976 | Mitchell | 15/235.8 |
| 4,757,572 | 7/1988 | Yon | 15/235.7 |
| 4,915,610 | 4/1990 | Curry | 425/458 |
| 5,544,384 | 8/1996 | Forselius et al. | 15/235.7 |
| 5,664,280 | 9/1997 | Tonsager | 15/235.7 |
| 5,699,580 | 12/1997 | Silverstein | 15/235.7 |

*Primary Examiner*—Terry Lee Melius
*Assistant Examiner*—Gary S. Hartmann

[57] ABSTRACT

A concrete finishing device for steps including a trowel blade and an adjustable gauge coupled with respect to the trowel blade. The adjustable gauge can be adjusted to correspond with the width of a form riser on concrete steps to allow the concrete poured beneath the form riser to be properly finish the steps.

1 Claim, 2 Drawing Sheets

CONCRETE FINISHING DEVICE FOR STEPS

BACKGROUND OF THE INVENTION

1. Field of the Invention

The present invention relates to a concrete finishing device for steps and more particularly pertains to smoothing poured concrete beneath formed riser on steps with a concrete finishing device for steps.

2. Description of the Prior Art

The use of concrete trowels is known in the prior art. More specifically, concrete trowels heretofore devised and utilized for the purpose of applying and smoothing various materials are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,947,916 to Mitchell discloses a trowel for masonry steps. U.S. Pat. No. 3,373,458 to Haivala discloses a step tool. U.S. Pat. No. 4,884,312 to Clark discloses a hand trowel. U.S. Pat. No. Des. 296,294 to Neece discloses the ornamental design for a concrete trowel. U.S. Pat. No. 4,822,209 to Dragich discloses an elongated concrete groover. U.S. Pat. No. 4,196,235 to Lindqvist discloses methods and apparatus for spreading semi-liquid compositions on a base surface.

While these devices fulfill their respective, particular objective and requirements, the aforementioned patents do not describe a concrete finishing device for steps for smoothing poured concrete beneath formed riser on steps.

In this respect, the concrete finishing device for steps according to the present invention substantially departs from the conventional concepts and designs of the prior art, and in doing so provides an apparatus primarily developed for the purpose of smoothing poured concrete beneath formed riser on steps.

Therefore, it can be appreciated that there exists a continuing need for new and improved concrete finishing device for steps which can be used for smoothing poured concrete beneath formed riser on steps. In this regard, the present invention substantially fulfills this need.

SUMMARY OF THE INVENTION

In the view of the foregoing disadvantages inherent in the known types of concrete trowels now present in the prior art, the present invention provides an improved concrete finishing device for steps. As such, the general purpose of the present invention, which will be described subsequently in greater detail, is to provide a new and improved concrete finishing device for steps and method which has all the advantages of the prior art and none of the disadvantages.

To attain this, the present invention essentially comprises a trowel blade having an upper surface and a lower surface. The upper surface has a handle secured thereto. The handle is positioned closer to a back end than a front end of the trowel blade. The lower surface is dimensioned for troweling a surface of a step. The trowel blade has a countersunk screw extending upwardly therethrough inwardly of the front end. An adjustable gauge is coupled with respect to the trowel blade. The adjustable gauge comprises an L-shaped support adjustably coupled to the upper surface of the trowel blade inwardly of the front end thereof. The L-shaped support has a horizontal portion and a vertical portion. The horizontal portion has a slot extending therethrough across a width thereof. The horizontal portion is positioned on the upper surface of the trowel blade with the slot receiving the countersunk screw therethrough. A wing nut couples with the countersunk screw for tight securement of the adjustable gauge to the trowel blade.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved concrete finishing device for steps which has all the advantages of the prior art concrete trowels and none of the disadvantages.

It is another object of the present invention to provide a new and improved concrete finishing device for steps which may be easily and efficiently manufactured and marketed.

It is a further object of the present invention to provide a new and improved concrete finishing device for steps which is of durable and reliable construction.

An even further object of the present invention is to provide a new and improved concrete finishing device for steps which is susceptible of a low cost of manufacture with regard to both materials and labor, and which accordingly is then susceptible of low prices of sale to the consuming public, thereby making such a concrete finishing device for steps economically available to the buying public.

Even still another object of the present invention is to provide a new and improved concrete finishing device for steps for smoothing poured concrete beneath formed riser on steps.

Lastly, it is an object of the present invention to provide a new and improved concrete finishing device for steps including a trowel blade and an adjustable gauge coupled with respect to the trowel blade. The adjustable gauge can be adjusted to correspond with the width of a form riser on concrete steps to allow the concrete poured beneath the form riser to be properly finish the steps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
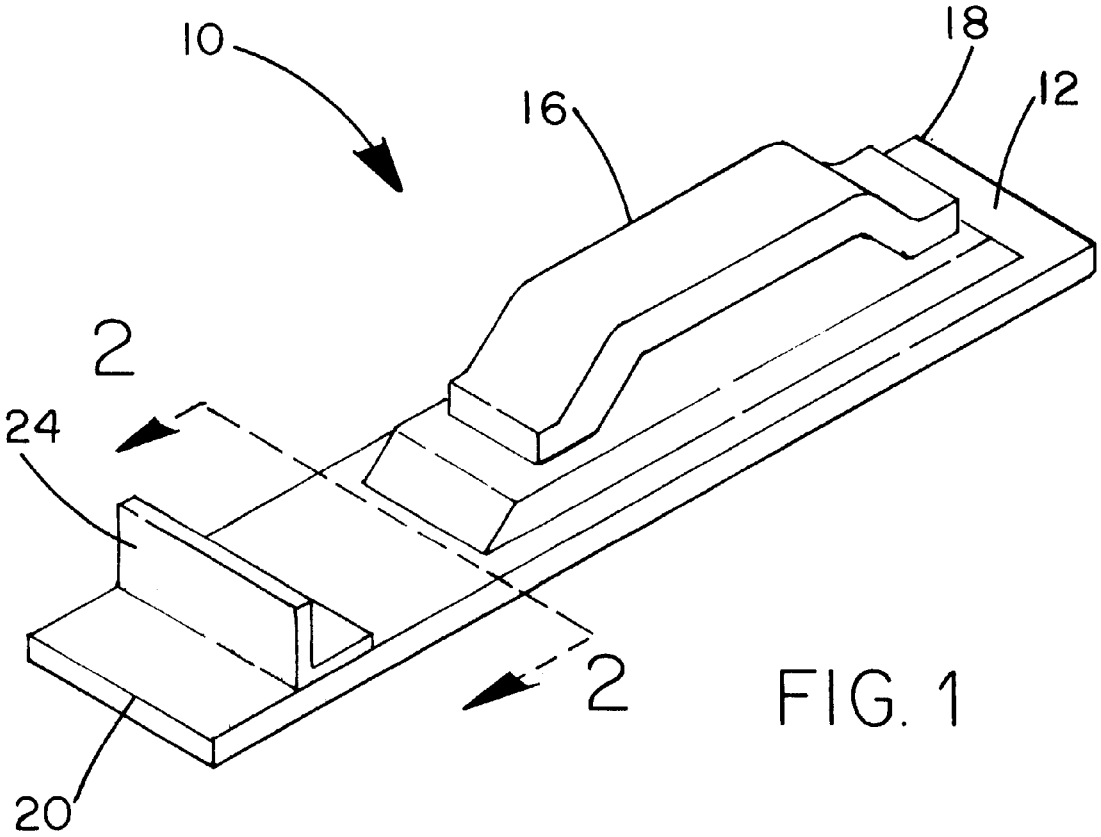
FIG. 1 is a perspective view of the preferred embodiment of the concrete finishing device for steps constructed in accordance with the principles of the present invention.
Figure 2:
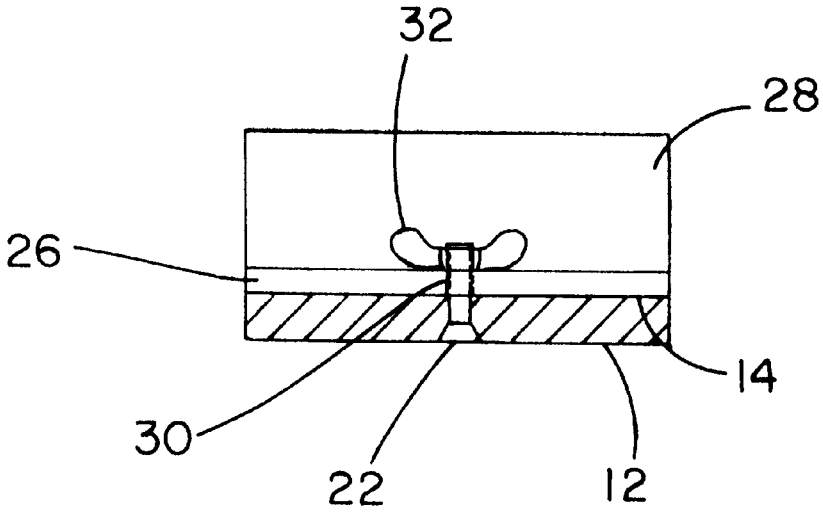
FIG. 2 is a cross-sectional view as taken along line 2—2 of FIG. 1.
Figure 3:
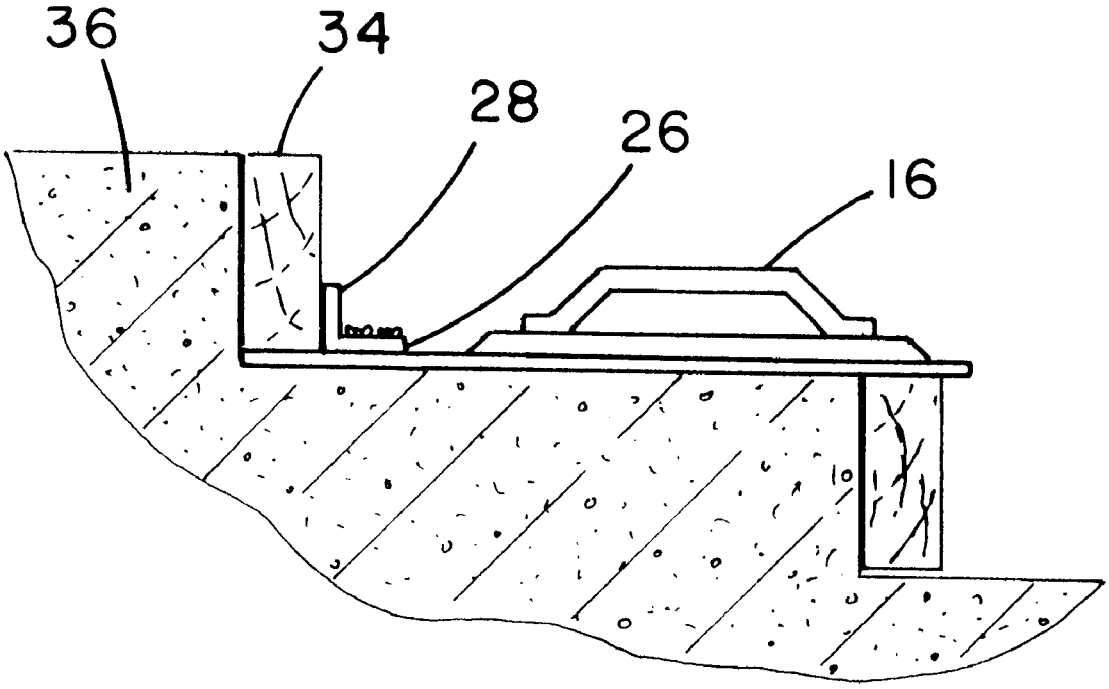
FIG. 3 is a side view of the present invention illustrated in use.

With reference now to the drawings, and in particular, to FIGS. 1 through 3 thereof, the preferred embodiment of the new and improved concrete finishing device for steps embodying the principles and concepts of the present invention and generally designated by the reference number 10 will be described.

Specifically, it will be noted in the various Figures that the device relates to a concrete finishing device for steps for smoothing poured concrete beneath formed riser on steps. In its broadest context, the device consists of a trowel blade and an adjustable gauge. Such components are individually configured and correlated with respect to each other so as to attain the desired objective.

The trowel blade 12 has an upper surface 14 and a lower surface 16. The upper surface 14 has a handle 16 secured thereto. The handle 16 is positioned closer to a back end 18 than a front end 20 of the trowel blade 12. Note FIG. 1. The lower surface 16 is dimensioned for troweling a surface of a step. Note FIG. 3. The trowel blade 12 has a countersunk screw 22 extending upwardly therethrough inwardly of the front end 20. Note FIG. 2.

The adjustable gauge 24 is coupled with respect to the trowel blade 12. The adjustable gauge 24 comprises an L-shaped support adjustably coupled to the upper surface 14 of the trowel blade 12 inwardly of the front end 20 thereof. The L-shaped support has a horizontal portion 26 and a vertical portion 28. The horizontal portion 26 has a slot 30 extending therethrough across a width thereof. Note FIG. 2. The horizontal portion 26 is positioned on the upper surface 14 of the trowel blade 12 with the slot 30 receiving the countersunk screw 22 therethrough. A wing nut 32 couples with the countersunk screw 22 for tight securement of the adjustable gauge 24 to the trowel blade 12. Optimally, the device 10 will be provided with a pair of wing nuts and a pair of countersunk screws so as to prevent any unwanted pivoting of the adjustable gauge 24 while in use.

In use, the adjustable gauge 24 is adjusted so that the distance between the vertical portion 24 and the front end 20 of the trowel blade is ever so slightly less than the width of the form riser 34 so that the trowel blade 12 can be slid beneath the riser 34 in order to smooth the surface thereunder without abutting the step 36 behind the riser 34. Note FIG. 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A concrete finishing device for steps for smoothing poured concrete beneath a formed riser on steps comprising, in combination:

a trowel blade having an upper surface and a lower surface, the upper surface having a handle secured thereto, the handle positioned closer to a back end than a front end of the trowel blade, the lower surface dimensioned for troweling a surface of a step, the trowel blade having a countersunk screw extending upwardly therethrough inwardly of the front end; and an adjustable gauge coupled with respect to the trowel blade, the adjustable gauge comprising an L-shaped support adjustably coupled to the upper surface of the trowel blade inwardly of the front end thereof, the L-shaped support having a horizontal portion and a vertical portion, the horizontal portion having a slot extending therethrough across a width thereof, the horizontal portion positioned on the upper surface of the trowel blade with the slot receiving the countersunk screw therethrough, a wing nut couples with the countersunk screw for tight securement of the adjustable gauge to the trowel blade, the horizontal portion having a planar outer surface for squarely abutting a planar surface of a formed riser.

* * * * *